United States Patent [19]

Azuma

[11] Patent Number: 4,833,502

[45] Date of Patent: May 23, 1989

[54] IMAGE FORMING APPARATUS HAVING AN IMAGE BEARING MEMBER RECIPROCALLY MOVABLE IN THE DIRECTION OF THE ROTATIONAL AXIS THEREOF

[75] Inventor: Jun Azuma, Tokyo, Japan

[73] Assignee: Canon Kabushiki Kaisha, Tokyo, Japan

[21] Appl. No.: 266,248

[22] Filed: Oct. 28, 1988

Related U.S. Application Data

[63] Continuation of Ser. No. 883,770, Jul. 9, 1986, abandoned.

[30] Foreign Application Priority Data

Jul. 11, 1985 [JP] Japan ..... 60-153019
Dec. 23, 1985 [JP] Japan ..... 60-291166

[51] Int. Cl.[4] ..... G03G 15/00

[52] U.S. Cl. ..... 346/160; 355/211; 355/233

[58] Field of Search ..... 355/3 R, 3 DR, 8, 133; 346/160; 74/56

[56] References Cited

U.S. PATENT DOCUMENTS 3,417,629 12/1968 Bloom ..... 74/56
3,538,646 11/1970 Beal ..... 75/56 X
4,326,793 4/1982 Buholtz ..... 355/3 DR
4,425,036 1/1984 Rameyama et al. ..... 355/3 DR

FOREIGN PATENT DOCUMENTS 56-6253 1/1981 Japan ..... 355/3 DR

*Primary Examiner*—A. C. Prescott
*Assistant Examiner*—J. Pendegrass
*Attorney, Agent, or Firm*—Fitzpatrick, Cella, Harper & Scinto

[57] ABSTRACT

The present invention prevents a particular portion of a drum-like image bearing member from being physically damaged or chemically deteriorated by the image bearing member being reciprocally moved in the direction of the rotational axis thereof. For this purpose, the rotational movement of a rotary shaft driving the image bearing member is utilized to produce a force for moving the image bearing member in the direction of the rotational axis.

8 Claims, 6 Drawing Sheets

IMAGE FORMING APPARATUS HAVING AN IMAGE BEARING MEMBER RECIPROCALLY MOVABLE IN THE DIRECTION OF THE ROTATIONAL AXIS THEREOF

This application is a continuation of application Ser. No. 883,770, filed July 9, 1986, now abandoned.

BACKGROUND OF THE INVENTION

1. Field of the Invention

The present invention is applicable to copying machines, recording apparatuses and other image forming apparatus in which the electrophotographic method or the electrostatic recording method are used.

2. Related Background Art

As shown in FIG. 3 of the accompanying drawings, in an apparatus of this type, for example, a recording apparatus using the electrophotographic method, a cleaning blade 21 in a cleaning device is used against the surface of a photosensitive drum to remove any toner remaining on the photosensitive drum after a toner image is transferred to a transfer material. If the positional relation in the axial direction of the drum between the clean blade and the photosensitive drum is fixed, the photosensitive drum always has the same portion thereof rubbed by the blade. Therefore, the influence of a flaw or flaws on the blade or minute foreign materials having entered between the blade and the photosensitive drum concentrates upon the same portion of the photosensitive drum to damage or deteriorate the photosensitive drum.

Also, in a laser beam printer, if the same format is continuously and repetitively printed, the pattern of that format is memorized on the photosensitive layer of the photosensitive member due to the axial fixing of the photosensitive drum, and this has led to a problem that for some time even after the format has been changed, the previous format is printed thinly.

Also, as means for avoiding the same portion of the photosensitive drum being rubbed by the cleaning blade, it has heretofore been practiced that the cleaning blade of the cleaning device used to form an image on the photosensitive drum or a separating pawl for separating a transfer material from the photosensitive drum is moved in the direction of the rotational axis of the drum.

SUMMARY OF THE INVENTION

However, these conventional mechanisms have required an independent driving mechanism discrete from the driving mechanism for the photosensitive mechanism and have therefore been complicated in construction. The present invention solves the above-noted problems by a simple and inexpensive construction.

The image forming apparatus of the present invention which solves the above noted problems peculiar to the prior art has a rotatable cylindrical image bearing member, drive means for reciprocally moving the image bearing member axially thereof from the rotational movement of the image bearing member, and process means used to form an image on the image bearing member, the image bearing member being reciprocally moved in the direction of the rotational axis thereof. By moving the image bearing member in a reciprocal manner along its rotational axis, deterioration of the image bearing member due to prolonged uniform contact with a stationary member such as a cleaning blade can be significantly reduced.

The image bearing member may be an electrophotographic photosensitive member, or a drum for retaining a latent image or a toner image thereon, such as an insulating drum. The process means include latent image forming means, a developing device, a cleaning device and separating means for separating a transfer material from the image bearing member, but it is not requisite for the apparatus of the present invention to have all of these means.

Where a photoconductive layer is used for the image bearing member, the deterioration of a particular portion of the image bearing member by light is prevented by the present invention. Also, the drive means can utilize a driving system for driving the image bearing member and thus, the driving system can be simplified.

DESCRIPTION OF THE PREFERRED EMBODIMENTS

The present invention will hereinafter be described in detail with reference to the drawings.

Figure 1:
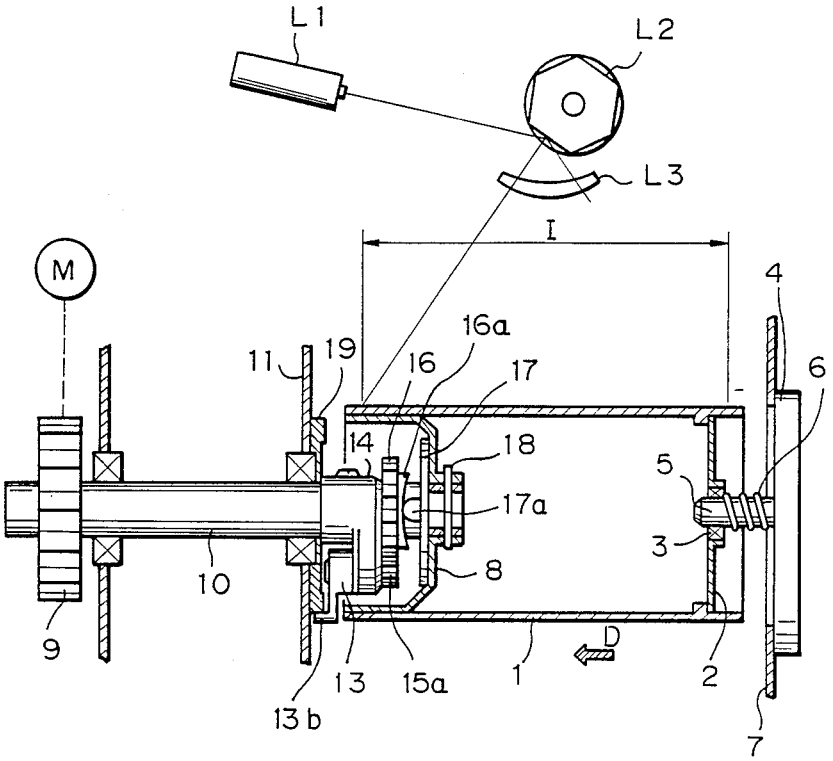
FIG. 1 is an axial cross-sectional view of a rotational member driving device.

FIG. 1 is a cross-sectional view of a photosensitive drum showing an embodiment of the driving device for an image bearing member to which the present invention is applied. In FIG. 1, reference numeral 1 designates a photosensitive drum having a photosensitive layer on the surface thereof. A modulated laser light is applied from a laser light source L1 to the drum 1 through the intermediary of a rotational mirror L2 and an f-$\theta$ lens L3. The area I on the photosensitive drum 1 shows the image area by said laser light. The recording apparatus is such that a corona discharger is disposed upstream of the area to which light information is applied and well-known image forming means such as a developing device, a transfer discharger and a cleaning device are disposed downstream of said area. A detailed description of these well known image forming means is omitted herein. In FIG. 1, a bearing 3 is forced into the center of the fore flange 2 of the photosensitive drum 1. Reference numeral 5 denotes a positioning pin for the photosensitive drum. The pin 5 and the bearing 3 are fitted to each other so as to be axially movable. Also, the pin 5 is integral with a positioning plate 4 and is fixed to the front side plate 7 of the copying apparatus. A compression spring 6 is incorporated between the bearing 3 and the plate 4. The photosensitive drum 1, the rear flange 8 of the drum and the fore flange 2 of the drum are normally biased in the direction of arrow D. An operating gear 9 rotated by the gear of a motor M which is the drive source of the photosensitive drum 1 is fixed to a shaft 10. The shaft 10 and pin 5 serve to support the drum 1 on opposite ends thereof. An eccentric cam 19 which constitutes means for moving the photosensitive drum along the direction of the rotary shaft thereof is fixed to a rear side plate 11. A cam lever 13 is normally biased in the direction of arrow B by the tension spring 20 of FIG. 2 and bears against the outer peripheral portion of the eccentric cam 19. A gear shaft 15 is on the drum side of the lever 13, the one-way clutch is mounted on a portion fitted to the cam lever 13 while being forced in toward the cam lever side. The rotation control direction of this one-way clutch is set to a direction in which rotation of the cam lever 13 is controlled when the cam lever 13 is rotated in the direction of arrow A with the gear shaft 15 being fixed.

A cam lever base 14 is fixed to the shaft 10 and supports the cam lever 13 and the gear shaft 15. A one-way clutch is also provided in the portion in which the cam lever base 14 and the gear shaft 15 are fitted to each other, and is forced in toward the cam lever base 14. The rotation control direction of the gear shaft 15 relative to the cam lever base 14 is the same as that in the case of the cam lever 13. Accordingly, in FIG. 3, the gear shaft 15 is rotated in the direction of arrow C when the cam lever 13 is rotated in the direction of arrow A.

An idler gear 16 will now be described. This gear 16 has a cam surface 16*a* on the corresponding peripheral surface thereof. The rear flange 8 of the drum is integral with a follower plate 17 which bears against the cam surface 16*a* of the idler gear 16. By the pin 17*a* of the follower plate 17 being pushed by the cam surface 16*a* of the idler gear 16, the photosensitive drum 1 is moved in the direction of arrow E indicated in FIG. 3. The movement of the photosensitive drum 1 in the direction of arrow D is accomplished by the compression spring 6. A parallel pin 18 is forced into the rear flange 8 of the drum and axially slides in the slotted portion of the shaft 10. Thus, it is possible that the rotational movement of the shaft 10 is transmitted to the photosensitive drum 1 while the rear flange 8 of the drum is reciprocated axially.

In FIG. 1, letter I designates the widthwise area of the photosensitive drum in which an image is formed. In the present embodiment, a part of the abovedescribed mechanism exists overlapping within this area I, whereby the inferior space effect is improved, and this can be said to be a progressive construction, but is not requisite factor.

The operation of the above-described construction will now be described.

Figure 3:
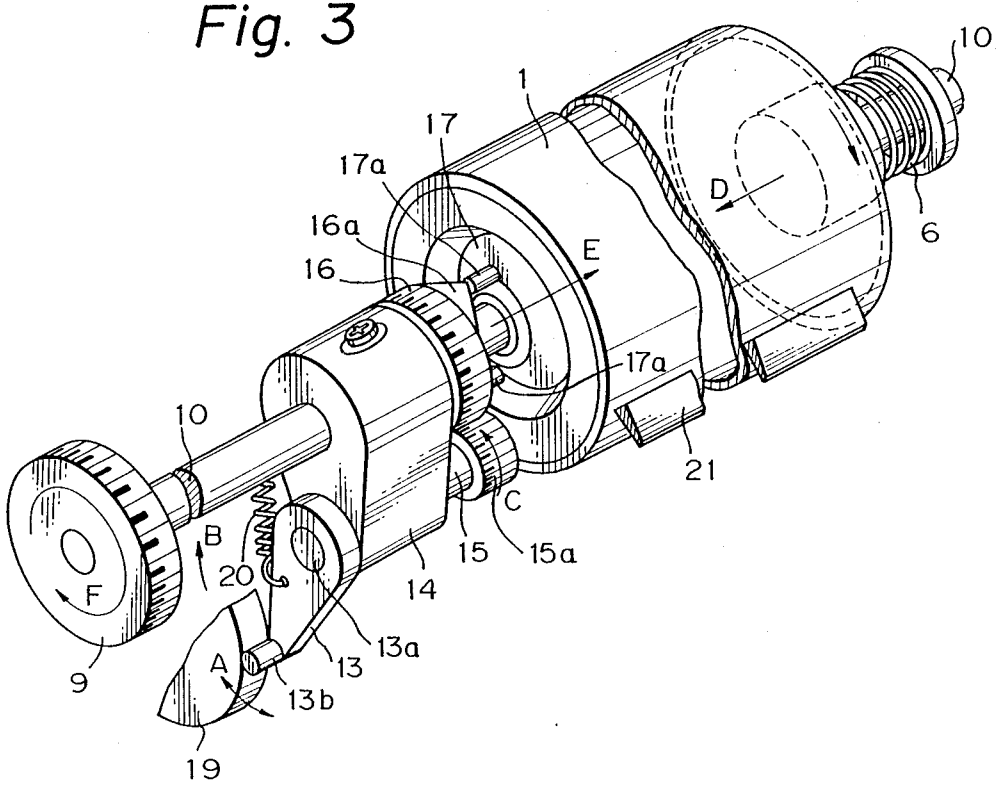
FIG. 3 is a perspective view of the rotational member driving device.

In FIG. 3, clockwise (arrow F) rotation of the operating gear 9 causes rotation of the lever base 14 integral with the drum shaft 10, the cam lever 13 and the gear shaft 15 in the direction of each respective arrow. That is, the cam lever 13 is normally biased in the direction of arrow B by the tension spring 20. This cam lever 13 follows the cam 19 mounted eccentrically relative to the center of rotation of the shaft 10, thereby rotating about the shaft 13*a* by an angle corresponding to the amount of eccentricity. As described previously, in the portion wherein the cam lever 13 and the gear shaft 15 of the lever base 14 are fitted to each other, a one-way clutch is forced in the same direction of locking and therefore, the gear shaft 15 is rotated only in the direction of arrow C. Further, a blade plate 21 secured to the cleaning device for removing any residual toner bears against and is opposed to the peripheral surface of the photosensitive drum 1.

Description will now be made of the reduction ratio by the eccentric cam 19 and cam lever 13.

Figure 4:
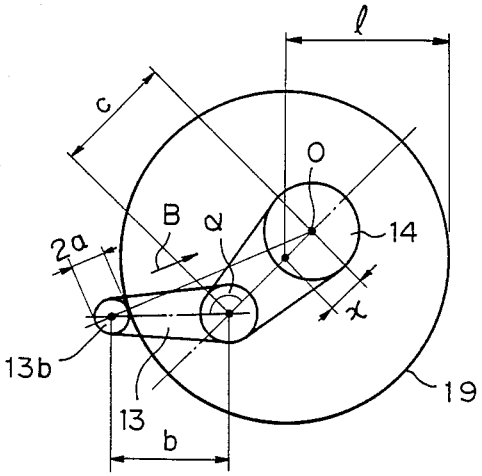
FIG. 4 illustrates the dimensions of the reduction gear mechanism using the eccentric cam.

The dimensions of various portions are determined to be 2*a, b, c, l, x* and $\alpha$, respectively, as shown in FIG. 4. That is, the amount of eccentricity of the eccentric cam from the center of the rotational member is x. The angle $\alpha$ becomes greatest when the lever 13 passes the cam surface of the eccentric cam 19 which is remotest from the center O of rotation. The angle is then $\alpha$max. Conversely, the angle $\alpha$ becomes smallest when the lever 13 passes the surface of the eccentric cam 19 which is nearest to the center O of rotation, and the angle is then $\alpha$min.

$$\cos\alpha\min = \frac{b^2 + c^2 - (a + l - x)^2}{2 \cdot b \cdot c} \quad (1)$$

$$\cos\alpha\max = \frac{b^2 + c^2 - (a + l + x)^2}{2 \cdot b \cdot c} \quad (2)$$

are established and therefore, when it makes one full rotation on the cam surface of the eccentric cam 19, the cam lever 13 rotates by $$\alpha\max - \alpha\min\ (=\beta) \quad (3).$$

Therefore, the reduction ratio m1 by the eccentric cam 19 and lever 13 is $$m1 = \beta/2\pi \quad (4).$$

Further, if the number of teeth of a pinion 15*a* supported on the gear shaft 15 and the number of teeth of the gear 16 of the cam shaft are Zp and Zg, respectively, the reduction ratio m2 by the gear shaft 15 and the gear 16 of the cam shaft is $$m2 = Zp/Zg \quad (5).$$

Accordingly, the number of rotations of the shaft 10 is reduced at the reduction ratio of $$m_1 m_2 = \frac{\left[\cos^{-1}\left\{\frac{b^2 + c^2 - (a + l + x)^2}{2bc}\right\} - \cos^{-1}\left\{\frac{b^2 + c^2 - (a + l - x)^2}{2bc}\right\}\right]}{2\pi} \times \frac{Zp}{Zg} \quad (6)$$

Figure 5:
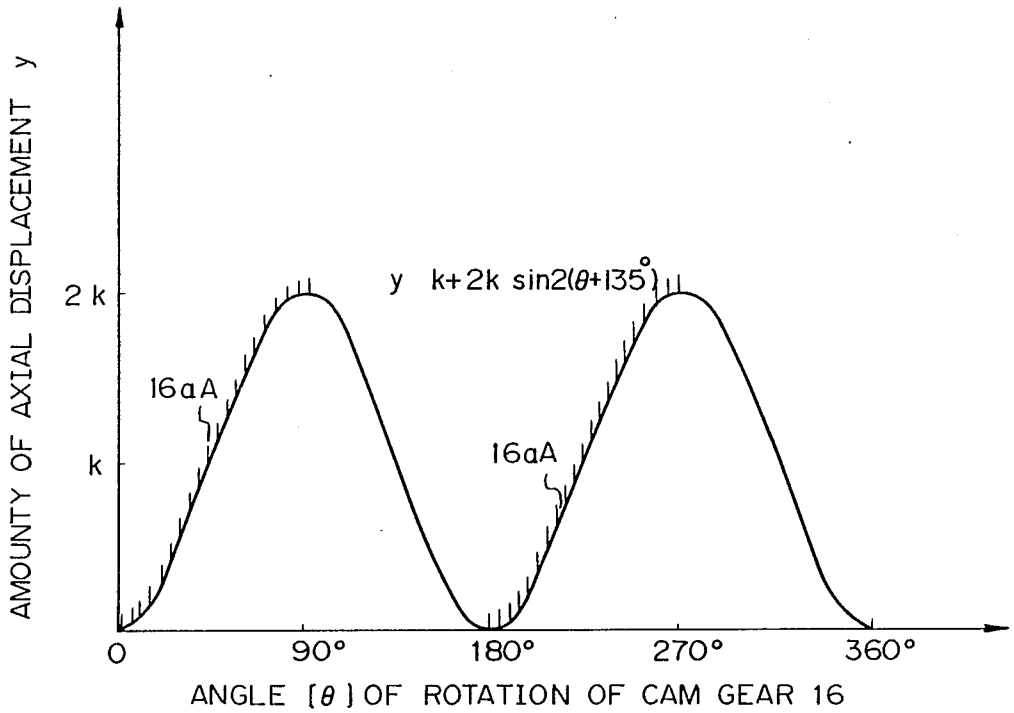
FIG. 5 is a graph showing the angle of rotation and the amount of axial movement of a gear with a cam.
Figure 6:
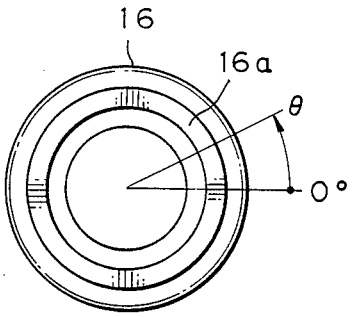
FIG. 6 is a front view of the gear with a cam.
Figure 7:
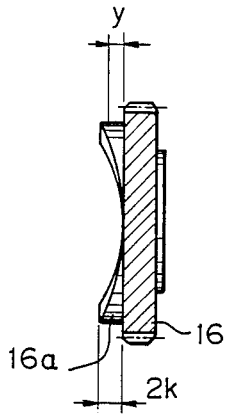
FIG. 7 is a side view of the gear with a cam.

The cam surface 16*a* of the gear 16 with a cam is formed by a sine curve, as shown in FIG. 5. By the pin portion 17*a* of the follower plate 17 bearing against the range of the cam surface 16*a*, the rear flange 8 of the drum coupled to the follower plate 17 and the photosensitive drum 1 are moved by a slight amount in the direction of arrow E in FIG. 3 in connection with said reduction ratio. Since the pin 17*a* of the follower plate 17 is provided at each of two positions opposed to each other at an angle of rotation of 180° and therefore, the final reduction ratio m is $$m = 2m1m2 \quad (7).$$

The driving in the direction of arrow E in FIG. 3 is accomplished by the rotational torque of the shaft 10 being transmitted to the lever base 14, the cam lever 13, the gear shaft 15, the gear 16 with a cam and the follower plate 17. On the other hand, the driving in the direction of arrow D in FIG. 3 is accomplished by the restitutive force of the compression spring 6 as described above.

The process of forming a latent image on the above-described photosensitive drum uses the conventional corona charger and application of information light. Development is effected by toner, and removal of any residual toner is accomplished by the use of frictional means such as a blade in the cleaning device. A showing and description of these conventional means is omitted herein.

Figure 9:
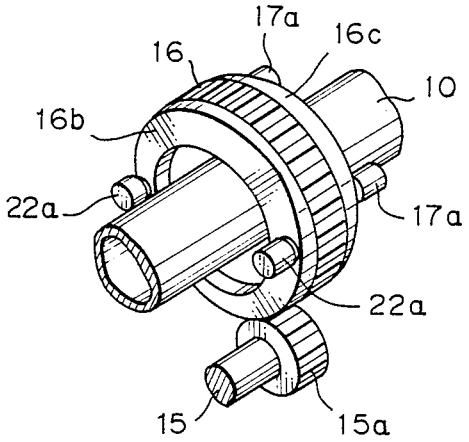
FIG. 9 is a perspective view of the surroundings of the gear with a cam shown in FIG. 8.
Figure 8:
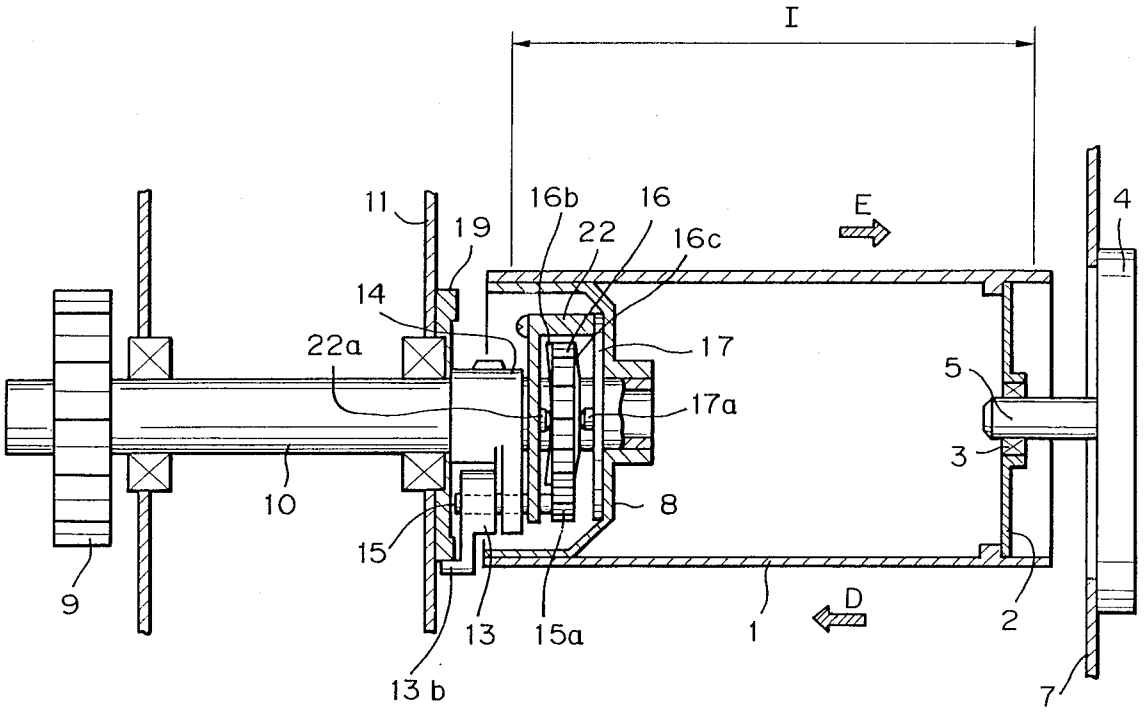
FIG. 8 is an axial cross-sectional view of a rotational member driving device which is another embodiment.

In the embodiment of the present invention as shown in FIG. 3, the driving of the photosensitive drum 1 in the direction of arrow D is accomplished by the compression spring 6, and the driving of the drum 1 in the direction of arrow E is realized by the cam surface 16*a* of the gear 16 with a cam pushing the pin portion 17*a* to thereby push the follower plate 17. Alternatively, however, as shown in FIGS. 8 and 9, the driving of the photosensitive drum in the direction of arrow D may be realized by the use of members functionally similar to the cam surface 16*a* and the follower plate 17, instead of using the compression spring 6.

That is, use may be made of a gear with a cam which is provided with cam surfaces 16*b* and 16*c* made concave and convex, respectively, toward the operating gear 9 side and the photosensitive drum 1 side by modifying the gear 16 with a cam. A cam follower 22 having a convex portion 22*a* at a position corresponding to the cam surface 16*b* is newly provided. This cam follower 22 is fitted to the shaft 10 for axial movement. On the other hand, the cam follower 22 is made integrally with the follower plate 17 and the rear flange 8 by being screwed thereto. The rear flange 8 is axially movable relative to the rotary shaft 10 and at the same time is subjected to the rotational force of the shaft 10. When the gear 9 is rotated by being driven by the above-described construction, the shaft 10 is rotated and along therewith, the rear flange 8 attached to the shaft 10 is rotated to thereby rotate the photosensitive drum 1. Also, the cam surfaces 16*b* and 16*c* of the gear 16 with a cam are sandwiched in opposed relationship with each other by and between the convex portion 17*a* of the follower plate 17 integral with the rear flange 8 as described above and the convex portion 22*a* of said cam follower 22. Accordingly, when the gear 16 with a cam is rotatively driven by the pinion 15, the cam follower 22 movable in the direction of the rotational axis of the shaft 10 and the follower plate 17 follow the cam configurations of the cam surfaces 16*b* and 16*c* of the gear 16 with a cam and move in the directions of arrows E and D. As a result, they reciprocally move the photosensitive drum 1 relative to the direction of the rotational axis of the shaft 10 within the range of the concave and convex configuration of the cam. In this case, the parallel pin 18 is changed from a configuration for only fixing the rear flange 8 to the shaft 10 to a configuration for rendering the rear flange 8 axially movable. Specifically, that side of the rear flange 8 which is adjacent to the pin 18 may be formed with a slot along the direction of the rotational axis.

Figure 2:
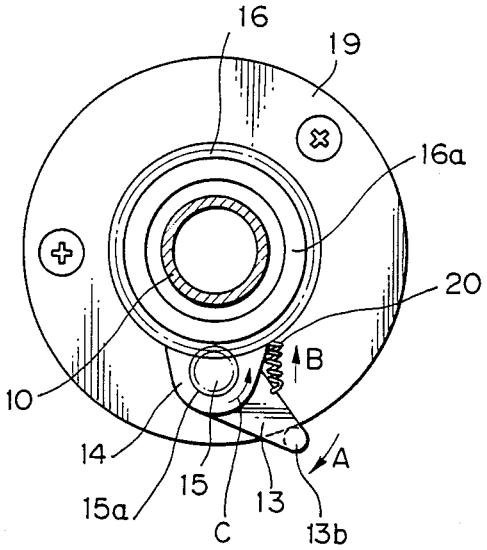
FIG. 2 is a front view of a reduction gear unit using an eccentric cam.

Also, as shown in FIG. 2, in the above-described embodiment, the cam lever 13 is designed to be biased in the direction of arrow B by the tension spring 20 and bear against the eccentric cam 19. However, if the cam surface of the eccentric cam 19 is made into the form of an eccentric groove and the hook 13*a* of the cam lever 13 is designed to rock following the cam groove, the tension spring 20 will become unnecessary.

According to the present invention, as described above, the fatigue and deterioration of the same portion of the image bearing member can be prevented and stable performance is ensured by the improved durability. That is, the image bearing member itself has a mechanism reciprocally movable in the direction of the rotational axis. In this manner, when the same portion of the image bearing member continues to be used for image formation and the sensitivity, characteristic of the photosensitive member deteriorates and the light source is a laser beam, production of a pattern memory in the laser beam printer can be prevented. Particularly, as in the present invention, by the mechanism reciprocally rotatable in the direction of the rotational axis being incorporated in the image bearing member itself, it becomes unnecessary to provide a drive mechanism discrete from the drive mechanism of the image bearing member, thus enabling the saving of the space for the entire apparatus. Also, the space saving effect is enhanced by constructing a part of this mechanism while overlapping it with a part of the image forming area of the peripheral surface of the image bearing member, as in the above-described embodiment.

I claim:

1. An image forming apparatus having a rotatable image bearing member reciprocably movable in an axial direction of a rotational axis thereof, said apparatus comprising;

means for rotating said image bearing member about the rotational axis;

means for supporting said image bearing member movable in the axial direction of the rotational axis; and means for reciprocating said image bearing member in the axial direction of the rotational axis, wherein at least a portion of said reciprocating means is provided inside said image bearing member, and further wherein said reciprocating means includes converting means for converting rotational motion into reciprocal motion, and at least said converting means is provide inside said image bearing member.

2. An apparatus according to claim 1, wherein said image bearing member is a photosensitive member and said apparatus further comprises a laser light source for exposing a photosensitive member to a modulated laser beam.

3. An image forming apparatus having a rotatable image bearing member reciprocally movable in an axial direction of a rotational axis thereof, said apparatus comprising;

means for rotating said image bearing member about the rotational axis;

means for supporting said image bearing member movable in the axial direction of the rotational axis; and means for reciprocating said image bearing member in the axial direction of the rotational axis, wherein at least a portion of said reciprocating means is provided inside said image bearing member, and further wherein a common drive source is used for said rotating means and said reciprocating means, and further wherein said reciprocating means comprises reducing means for reducing a rotational speed from said drive source, and converting means for converting the reduced rotational motion into reciprocal motion, and wherein at least a portion of said converting means and said reducing means is provided in the image bearing member, and further wherein said reducing means includes an eccentric cam and a gear to effect deceleration.

4. An apparatus according to claim 3, wherein at least a portion of said reciprocating means is provided within a longitudinal width of the image bearing member relating to the image formation.

5. An apparatus according to claim 3, wherein said image bearing member is a photosenstive member and said apparatus further comprises a laser light source for exposing a photosensitive member to a modulated laser beam.

6. An image forming apparatus having a rotatable image bearing member reciprocally movable in an axial direction of a rotational axis thereof, said apparatus comprising;

means for rotating said image bearing member about the rotational axis;

means for supporting said image bearing member movable in the axial direction of the rotational axis; and means for reciprocating said image bearing member in the axial direction of the rotational axis, wherein at least a portion of said reciprocating means is provided inside said image bearing member, and further wherein said rotating means and said reciprocating means share a driving axis which is coaxial with the rotational axis of said image bearing member.

7. An apparatus according to claim 6, wherein said image bearing member is a photosensitive member and said apparatus further comprises a laser light source for exposing a photosensitive member to a modulated laser beam.

8. An image forming apparatus having a rotatable image bearing member reciprocally movable in the direction of a rotational axis thereof, said apparatus comprising;

means for rotating said image bearing member in a one-way direction about the rotational axis;

a drive source for rotating said image bearing member;

means for supporting said image bearing member movable in the axial direction of the rotational axis;

means for reciprocating said image bearing member in the axial direction of the rotational axis; wherein said reciprocating means includes converting means for converting rotational motion into reciprocal motion, said converting means comprises cam followers corresponding to respective directions of the reciprocal motion, and further wherein at least a portion of said reciprocating means is provided inside of said image bearing member, and further wherein said reciprocating means further comprises reducing means for reducing a rotational force from said drive source, at least a portion of said reducing means is provided inside said image bearing member, and further wherein said reducing means includes an eccentric cam and a gear to effect deceleration.

* * * * *

UNITED STATES PATENT AND TRADEMARK OFFICE

CERTIFICATE OF CORRECTION

PATENT NO. : 4,833,502

DATED : May 23, 1989

INVENTOR(S) : JUN AZUMA

It is certified that error appears in the above-identified patent and that said Letters Patent is hereby corrected as shown below:

On the title page:

IN [56] REFERENCES CITED

U.S. PATENT DOCUMENTS, "Rameyama et al." should read --Kameyama et al.--.

COLUMN 1

Line 25, "clean blade" should read --cleaning blade--.

COLUMN 3

Line 45, "abovedescribed" should read --above-described--.

COLUMN 6

Line 5, "rock" should read --lock--.
Line 15, "sensitivity," should read --sensitivity--.
Line 35, "comprising;" should read --comprising:--.
Line 48, "provide" should read --provided--.
Line 57, "comprising;" should read --comprising:--.

COLUMN 7

Line 25, "comprising;" should read --comprising:--.

UNITED STATES PATENT AND TRADEMARK OFFICE

CERTIFICATE OF CORRECTION

PATENT NO. : 4,833,502

DATED : May 23, 1989

INVENTOR(S) : JUN AZUMA

It is certified that error appears in the above-identified patent and that said Letters Patent is hereby corrected as shown below:

COLUMN 8

Line 12, "comprising;" should read --comprising:--.

Signed and Sealed this

Seventeenth Day of July, 1990

*Attest:*

HARRY F. MANBECK, JR.

*Attesting Officer*

*Commissioner of Patents and Trademarks*